US011131463B2

(12) United States Patent
Mastilovic

(10) Patent No.: US 11,131,463 B2
(45) Date of Patent: Sep. 28, 2021

(54) OVEN WITH AN INTERNAL WATER TANK, IN PARTICULAR FOR HUMIDIFIED OR STEAM COOKING

(71) Applicant: SMEG S.p.A., Guastalla (IT)

(72) Inventor: Nebojsa Mastilovic, Cadelbosco Sopra (IT)

(73) Assignee: SMEG S.p.A., Guastalla (IT)

( * ) Notice: Subject to any disclaimer, the term of this patent is extended or adjusted under 35 U.S.C. 154(b) by 184 days.

(21) Appl. No.: 16/280,298

(22) Filed: Feb. 20, 2019

(65) Prior Publication Data

US 2019/0257529 A1 Aug. 22, 2019

(30) Foreign Application Priority Data

Feb. 20, 2018 (IT) ..... 102018000002871

(51) Int. Cl.
*F24C 15/32* (2006.01)
*F24C 15/00* (2006.01)

(52) U.S. Cl.
CPC ..... *F24C 15/327* (2013.01); *F24C 15/003* (2013.01)

(58) Field of Classification Search
CPC ..... F24C 15/327; D06F 33/00; D06F 34/28; D06F 39/0087; D06F 34/18; D06F 39/02; D06F 34/22; D06F 35/006; D06F 39/007; D06F 39/002; D06F 58/30; D06F 2204/02; D06F 2210/00; D06F 35/005; D06F 39/14; D06F 2202/02; D06F 2202/10; D06F 37/04; D06F 39/088; D06F 73/02; D06F 89/02; D06F 93/00; D06F 95/00;

(Continued)

(56) References Cited

U.S. PATENT DOCUMENTS

2011/0109208 A1 5/2011 Becker et al.
2014/0339332 A1 11/2014 Bartelick
2017/0367480 A1* 12/2017 Dickerson ..... F25D 25/025

FOREIGN PATENT DOCUMENTS

CN 106724769 A * 5/2017
EP 0517681 A2 9/1992

(Continued)

OTHER PUBLICATIONS

English translation of Xia, CN 106724769 A.*

(Continued)

*Primary Examiner* — Jason Lau
(74) *Attorney, Agent, or Firm* — The Belles Group, P.C.

(57) ABSTRACT

An oven comprising: a muffle defining a cooking chamber limited by a plurality of fixed walls and by a door selectively mobile between an open position and a closed position for allowing respectively the accessibility and the isolation of the cooking chamber; an internal water collection tank; a tubular loading device of water into the internal tank; wherein both with the door in the open position and with the door in the closed position the tubular loading device is selectively mobile between a static, not-working position and a loading position wherein it is at least in part orientable in the space outside the cooking chamber to reach a water source, wherein the oven comprises an outer frame covering the cooking chamber; in the not-working position the tubular loading device being substantially fully housed inside a cavity between the cooking chamber and the outer frame.

18 Claims, 6 Drawing Sheets

(58) Field of Classification Search
CPC ..... D06F 2101/00; D06F 2101/04; D06F 2101/20; D06F 2103/08; D06F 2103/50; D06F 2103/64; D06F 2105/26; D06F 2105/42; D06F 2202/085; D06F 2207/08; D06F 2204/086; D06F 2204/10; D06F 2214/00; D06F 2222/00; D06F 23/02; D06F 23/04; D06F 23/06; D06F 29/005; D06F 31/00; D06F 33/37; D06F 35/00; D06F 37/02; D06F 37/06; D06F 37/203; D06F 37/22; D06F 37/263; D06F 37/265; D06F 37/266; D06F 37/267; D06F 37/268; D06F 37/269; D06F 39/00; D06F 39/024; D06F 39/04; D06F 39/06; D06F 39/08; D06F 39/083; D06F 39/085; D06F 39/10; D06F 39/12; D06F 39/125; D06F 58/02; D06F 58/206; D06F 58/24; D06F 58/38; D06F 58/50; A47L 15/4217; A47L 15/44; A47L 2501/26; A47L 15/0049; A47L 15/241; A47L 15/4229; A47L 15/4463; A47L 15/449; A47L 2501/01; A47L 2501/02; A47L 2501/05; A47L 15/0021; A47L 15/0076; A47L 15/0081; A47L 15/22; A47L 15/4244; A47L 15/4293; A47L 15/4297; A47L 15/4418; A47L 2201/00; A47L 2401/09; A47L 2401/10; A47L 2401/12; A47L 2401/20; A47L 2501/30; A47L 11/4008; A47L 13/10; A47L 13/20; A47L 13/42; A47L 15/0005; A47L 15/0023; A47L 15/0028; A47L 15/0031; A47L 15/0034; A47L 15/0044; A47L 15/0055; A47L 15/0065; A47L 15/0068; A47L 15/0089; A47L 15/0092; A47L 15/16; A47L 15/23; A47L 15/24; A47L 15/4219; A47L 15/4223; A47L 15/4225; A47L 15/4257; A47L 15/4261; A47L 15/4278; A47L 15/4285; A47L 15/4287; A47L 15/4291; A47L 15/4409; A47L 15/4445; A47L 15/4454; A47L 15/4472; A47L 15/502; A47L 15/507; A47L 2301/04; A47L 2301/08; A47L 2401/023; A47L 2401/03; A47L 2401/06; A47L 2401/07; A47L 2401/14; A47L 2401/18; A47L 2401/19; A47L 2401/22; A47L 2401/24; A47L 2401/30; A47L 2501/04; A47L 2501/06; A47L 2501/07; A47L 2501/20
See application file for complete search history.

(56) References Cited

FOREIGN PATENT DOCUMENTS

| | | |
|---|---|---|
| EP | 2336643 A2 | 6/2011 |
| EP | 2375169 A1 | 10/2011 |
| EP | 3180984 | 6/2017 |

OTHER PUBLICATIONS

"Linear Solenoid Actuator", https://www.electronics-tutorials.ws/io/io_6.html (Year: 2016).*
Italian Search Report, Ministero dello Sviluppo Economico, dated Feb. 20, 2018.
European Office Action issued in European Application No. 19158399.6 dated Dec. 3, 2020.

* cited by examiner

OVEN WITH AN INTERNAL WATER TANK, IN PARTICULAR FOR HUMIDIFIED OR STEAM COOKING

CROSS-REFERENCE TO RELATED APPLICATIONS

This patent application claims priority from Italian Patent Application No. 102018000002871, filed on Feb. 20, 2018, the entire disclosure of which is incorporated herein by reference.

TECHNICAL FIELD

The present invention relates to an oven provided with an internal water tank in order to allow, for example, humidified or steam cooking. In particular, the present invention relates to a system for loading water in said inner tank. The indication "steam oven" refers specifically to those ovens equipped with a cooking chamber and a boiler configured to generate steam from water collected in an internal tank and to deliver the steam produced into the cooking chamber. This type of oven allows saturation of the cooking chamber with very high percentages of steam, usually greater than 80%, and the cooking of food takes place in the absence of other sources of heat. Conversely, humidified cooking ovens only introduce very low percentages of steam, usually less than 30%, into the cooking chamber, delegating the cooking of foods to other sources of heat, such as electric resistors. In fact, this low humidity is not designed to cook but only to give the products treated special characteristics.

STATE OF THE ART

With reference to the description in the previous chapter, an oven for humidified or steam cooking generally comprises a muffle defining a cooking chamber limited by a plurality of fixed walls and by a front door selectively mobile between an open and a closed position to allow respectively the accessibility and the isolation of the cooking chamber; and an internal water tank.

This tank is connected or is directly part of a boiler for generating steam and directly dispensing it in the cooking chamber. In the event that the oven is configured or operated for steam cooking, the percentage of steam introduced into the cooking chamber is such as to cook foods in the absence of other heating sources. Alternatively, in humidified cooking, the amount of steam introduced into the chamber is smaller and cooking of the food is delegated to other heating devices, for example electrical resistors. In humidified cooking, in fact, the tank may also be without a boiler and be connected to means configured to spray water in the cooking chamber without a prior generation of steam.

The present invention applies to both steam ovens, where the presence and/or actuation of the resistors of the cooking chamber is not required, and to humidified cooking in which cooking takes place in a conventional manner, for example with electrical resistors, and less steam is generated or water is directly sprayed into the cooking chamber. In general, therefore, the present invention applies to all ovens provided with an internal water tank.

In order to ensure the proper functioning of the aforementioned ovens with an internal water tank, it is of course necessary to provide for a periodic loading of water into the tank.

According to the prior art, there are currently substantially three different methods of loading water into the relative internal tank.

The first type involves extracting the tank from the oven by taking it from a special compartment made in the product. In this way it is possible to easily fill the tank by placing it, for example, under a tap. Once filled, the tank is reinserted into the oven to reconnect it to the hydraulic circuit supplying the boiler. This solution, although very practical, requires accessibility to the tank thereby reducing the volume of the cooking chamber or requiring special systems for opening the front parts of the oven, for example at the front control panel.

The second known type involves the presence of a drawer integrated into the oven, i.e. an extractable compartment that cannot be separated from the oven, which once opened allows the user to fill the internal tank with water. This drawer has a structure similar to the drawers for loading detergent usually installed in washing machines. This drawer loading provides for embodiments in which the drawer is hidden behind the oven door, i.e. as in the previous type, it is necessary to first open the oven door before loading operations. Alternatively, the drawer can be exposed and integrated into the front panel of the oven. The term front panel means a part of the fixed frame of the front face of the oven which supports the oven door and usually also has the controls for operating the oven.

A third known type, of which the present invention is part, provides for the loading of water into the inner tank by means of a particular device known as the loading "lance". This lance consists substantially of a hollow tubular water loading device that can be manually moved by the user or can be moved in a servo-assisted manner by means of a special electrical device. According to this prior art, when there is a need to load water into the oven, the user must introduce the free end of the lance into a water source, usually a specially filled container. In this condition, and as a result of a pump installed in the oven, water flows from the container to the internal tank passing inside the lance. The lance usually comprises a free head portion, known as the suction "probe" and made of rigid material for easy handling, and a flexible rear portion, usually made as extruded rubber, which connects the suction probe to the inner tank directly or indirectly. In this solution, therefore, the lance is selectively movable between a not-working position, in which it is connected to the oven with the rear rubber portion suitably wound, and a loading position in which the rubber part is unwound and the probe can be at least partially oriented in the space outside the cooking chamber to reach a water source. In order not to compromise the visible external appearance of the oven and not to provide portions protruding beyond the overall dimensions of the oven that could constitute a further obstacle, according to the prior art in the not-working position, the lance is entirely housed inside the oven, in particular in a gap between the cooking chamber and the external frame of the oven. According to the prior art, this lance housing gap is accessible to a user only with the oven door in the open position. In this embodiment, to grasp the lance or merely to access its free portion, it is therefore necessary to bring the oven door into the open position. As a result of this operation, the oven door in the open position is usually used as a support surface for the recipient of water in which to immerse the lance suction probe. This third type of oven also has drawbacks. In fact, during the cooking phases, the possible opening of the oven for loading water inevitably leads to a lowering of the cooking temperature or in general to the change in the desired cooking conditions created inside the oven. With the opening of the door, in fact, the steam flows out of the muffle substantially stopping cooking.

DESCRIPTION OF THE INVENTION

Starting from this prior art, in particular the third method of the prior art described, one object of the present invention is to create an alternative oven that makes it possible to overcome the drawbacks previously highlighted in a simple and economic manner, both from a functional point of view and from a constructional point of view.

According to such objectives, the present invention relates to an oven comprising a muffle defining a cooking chamber limited by a plurality of fixed walls and by a door selectively mobile between an open position and a closed position for allowing respectively the accessibility and the isolation of the cooking chamber; an internal tank for collecting water; and a hollow tubular device for loading water into the internal tank, wherein the tubular device is selectively mobile between a static not-working position and a loading position in which the tubular loading device is at least in part orientable in the space outside the cooking chamber to reach a water source.

In particular, according to the invention it is not necessary to open the oven door to switch from the not-working position to the loading position in order to perform the water loading operations. In other words, according to the present invention it is not necessary to open the oven door to access the tubular loading device and to manoeuvre it in order to immerse the free end, or loading probe, in the water source. In fact, both with the door in the open position and with the door in the closed position, the tubular loading device of the present invention is accessible directly or after a number of preliminary operations.

Therefore, advantageously the loading operations of water into the oven take place in a simple manner without the risk of interrupting or altering the cooking in progress.

Preferably, in the not-working position the tubular loading device is substantially entirely housed inside the oven, in an area outside the cooking chamber. In particular, the oven comprises an external cover frame of the cooking chamber that defines a gap between the cooking chamber and said external frame. In such embodiment, in the not-working position the tubular loading device is substantially entirely housed in an inner area reserved for it in the gap and comprises a free end, i.e. an end opposite the tank and provided with a water loading opening, substantially at the outer frame, preferably at the front face of the oven supporting the door of the cooking chamber.

As indicated above, the free end of the tubular loading device may be directly visible and accessible to a user from the outside of the oven or may be further protected, for example by a movable flap to be opened when necessary. In a preferred embodiment where the free end of the tubular loading device is exposed and directly accessible from the outside of the oven, the outer frame comprises a front portion, of the front panel or frame type, coupling with the door to realize/complete the front face of the oven. Between this frame or front panel and the door there is a slot through which the free end of the tubular loading device is accessible. According to two variants, at not-working position the exposed free end of the tubular loading device housed in the gap may be flush with the front face of the oven or in the internal rearward position. Advantageously, the tubular loading device of the present invention does not require design changes to the ovens produced today which in fact already have the aforementioned gap between the door and the frame (or front panel) of the oven.

The tubular loading device can be extracted by gripping it directly in its not-working position and pulling it manually towards the outside of the oven. Alternatively a push-pull device may be provided configured at one side to connect the tubular loading device in the not-working position and on the other side to release the tubular loading device from the not-working position and arrange the free end in a position projecting further from the front face of the oven, in particular, projecting by a distance such as to be easily manually grasped. In this embodiment, therefore, in order to grasp the tubular loading device it is first necessary to press on its free end to push it towards the inside of the oven and trigger the push-pull mechanism which, by elastic reaction, pushes the free end into the most extracted position from the front face of the oven.

Alternatively, the aforementioned operation of the push-pull mechanism for the first extraction of the tubular loading device can be carried out automatically by providing, for example, an electric actuator controlled by a special control button. Of course, the present invention does not rule out the possibility of further automating the extraction and positioning procedures of the tubular loading device in place, for example by means of a relative motorization.

According to the embodiment with the push-pull mechanism, the oven comprises a fixed seat, preferably in the form of a rigid case made by joining two semi-shells, placed inside the cavity between the muffle and the outer frame for housing at least part of the tubular loading device. Preferably the tubular device comprises a tubular element made of flexible material that extends substantially throughout the length of the tubular device defining a water transit channel. The flexible tubular element comprises a fixed inner end connected directly or indirectly to the tank and a movable outer end through which water enters the tubular device. At least the outer end of the tubular body is at least partially coated with a coating made of rigid material, preferably an aluminium profile, to facilitate the gripping and handling of said device. This rigid material coating can extend from the outer end to the inner end substantially as far as the rigid collar that winds the flexible tubular element and acts in conjunction with the push-pull device. In this case, the coating can be made in the form of several independent elements placed one after the other where in the contact areas there are notches or profiles such as to allow in any case a certain degree of flexibility also of the portion of the tubular element covered by the rigid coating.

According to one embodiment, the tubular device may be without the rigid ring acting in conjunction with the push-pull mechanism. In this case the spring of the push-pull mechanism (or in general the extraction devices) acts directly on the flexible tubular element, in particular on a peripheral portion of the section of the flexible tubular portion not at the internal water passage channel. This prevents narrowing of the through section for the spring action.

DESCRIPTION OF EMBODIMENTS OF THE INVENTION

Further characteristics and advantages of the present invention will become clear from the following description of a non-limiting example of an embodiment made with reference to the appended drawings, wherein.

Figure 1:
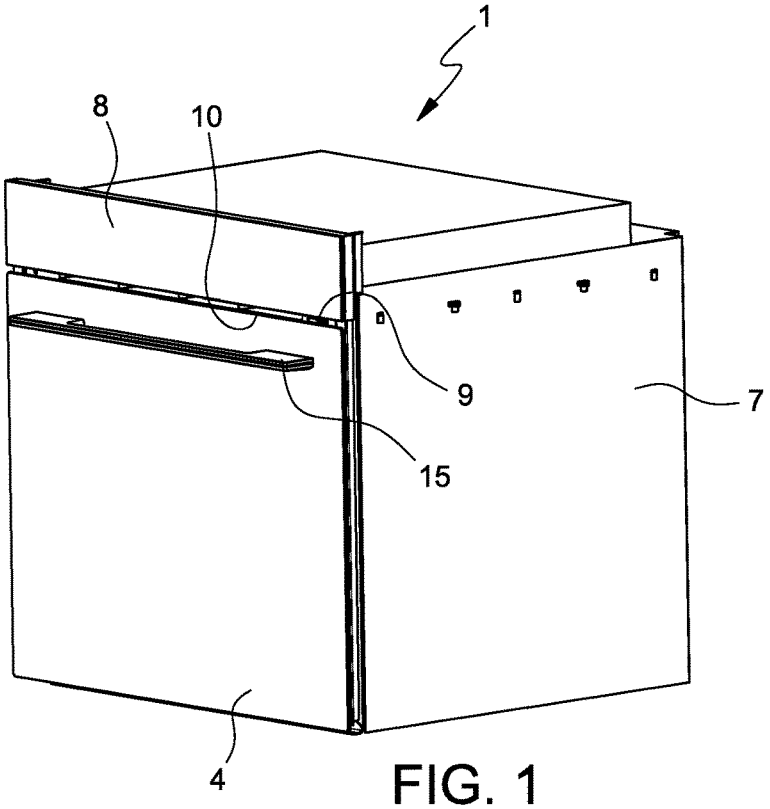
FIG. 1 is a schematic perspective view of an oven for steam cooking according to the present invention.

FIG. 1 shows a schematic perspective view of an embodiment of an oven 1 according to the present invention provided with an internal water collection tank for the realization, for example, of steam cooking or humidified cooking. In particular, the oven 1 in FIG. 1 comprises an outer frame 7 covering a muffle (not visible in FIG. 1) defining a cooking chamber. The muffle, schematically denoted by reference numeral 2, is limited by fixed walls 3 and a door 4 equipped with a special handle 15 on the front face of the oven 1. As is known, the door 4 is movable between a closed position, shown in FIG. 1 and in which it isolates the cooking chamber, and an open position that allows accessibility to the cooking chamber. The front face of the oven 1 further comprises a front portion 8 of the frame 7, known as the front panel, which forms a portion of frame positioned above the door 4. In this front panel 8 the oven control buttons 1 are usually installed. In the example shown, this frame 8 is placed only at one edge, the top edge, of the door 4, but it could also extend along other sides of the door 4. Between the edge of the door 4 and the frame 8 there is a slot 10 that connects the external environment to the oven 1 with a gap 10 between the muffle and the external frame 7. The oven 1 comprises an internal water collection tank 5 that can be supplied with water by means of a special hollow tubular loading device 6. In FIG. 1, only the free end 9 of this tubular loading device 6 is visible, which is in fact housed for all the remaining extension in the aforementioned gap 10. In the example of FIG. 1, and as more clearly visible in FIG. 3, at not-working position the free end 9 of the tubular loading device is substantially flush with the front wall of the oven 1 and is housed in the gap 10. In this condition, for a user standing in front of the oven, the free end 9 of the tubular loading device 6 takes the form of a simple button housed flush in the gap 10. In the example shown the cross-section of the tubular loading device 6 is substantially rectangular in shape due to the fact that the gap also has the same extension. However, the access opening to the gap may be of any shape and does not necessarily need to be a length equal to the length of the door 4. Similarly, the tubular loading device 6 may have any cross-section as long as it is can pass through the access opening to the cavity 10.

Figure 2:
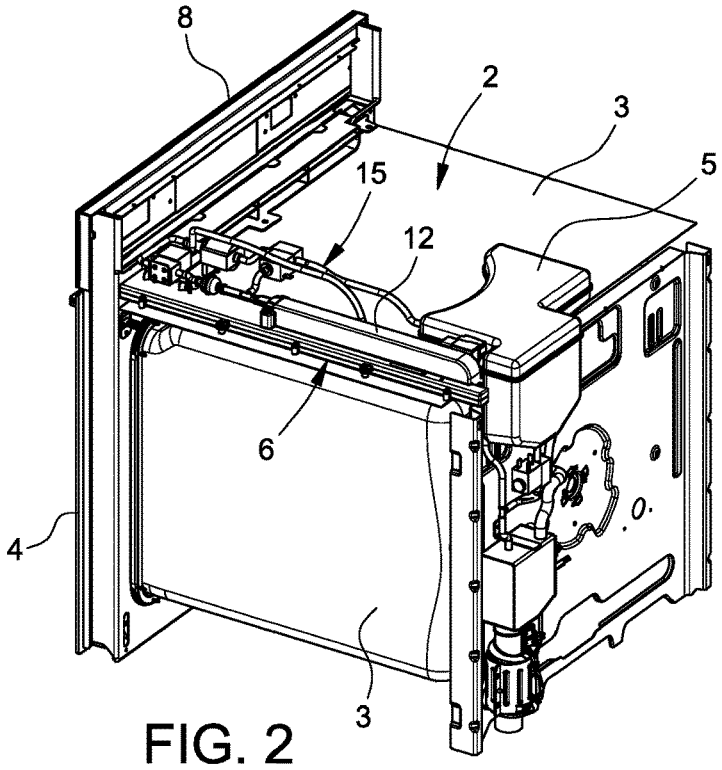
FIG. 2 is a schematic view of the oven in FIG. 1 without part of the external frame.

FIG. 2 shows a schematic view of the oven in FIG. 1 in which some walls of the outer frame 7 have been removed. Such FIG. 2 shows the gap 10 between the muffle 2 and the removed outer frame 7 as well as all the components housed in such cavity. In particular, FIG. 2 shows the tank 5 (schematically), the extension of the tubular loading device 6 beyond the free end 9 (although inserted in the relative fixed seat 12) and a series of hydraulic and electrical connections between the tubular loading device 6, the tank 5 and relative drives. These connections are shown in FIG. 2 by reference numeral 15. The construction details of a preferred embodiment of the tubular loading device and its fixed seat 12 will be described and shown with reference to the following FIGS. 6 to 8.

Figure 3:
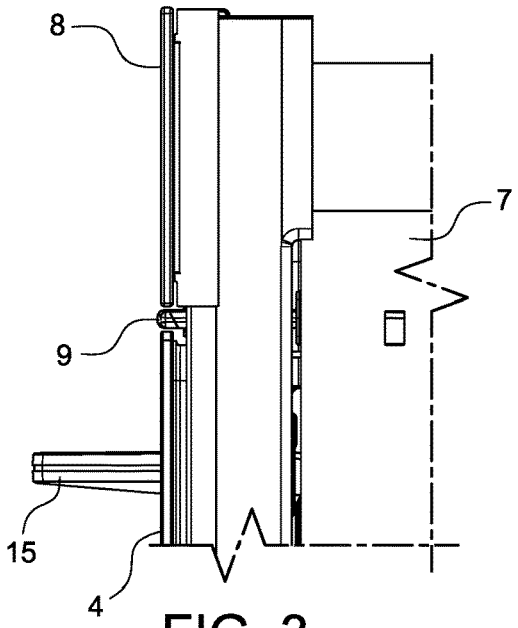
FIGS. 3-5 show the oven in FIG. 1 in three subsequent operating phases.
Figure 4:
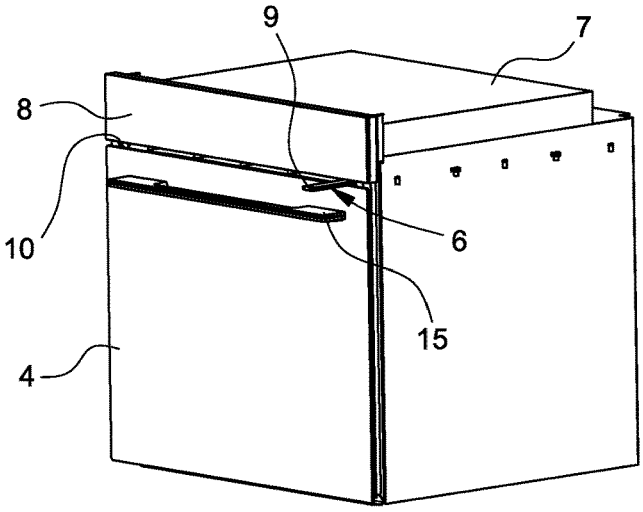
Figure 5:
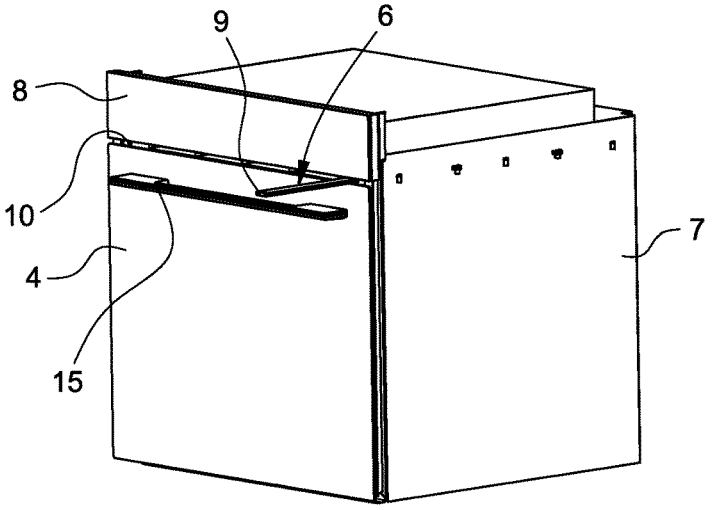

FIGS. 3 to 5 show the oven in FIG. 1 in three successive steps of using the tubular loading device 6. In particular, FIG. 3 shows a side view of a portion of the oven 1 that illustrates the positioning of the tubular loading device when in the not-working position. As seen in FIG. 3, in fact, the tubular loading device is in a position such that only its free end 9 is accessible and is housed in the gap 10 flush with the door 4 and the frame 8. FIG. 4 shows instead a first position of use in which most of the tubular loading device 6 protrudes from the gap 10 towards the outside of the oven 1. The transition from the position in FIG. 3 to that in FIG. 4 can take place in various ways. It is possible to provide embodiments in which the user simply proceeds by grasping the end 9 and pulling the tubular loading device outwards. Alternatively, it is possible to provide mechanisms capable of bringing the end 9 further outwards automatically or semi-automatically. These different solutions will be detailed in the description of the following figures. For example, a semi-automatic mechanism useful for this purpose can be a push-pull device that, following a pressure on the end 9, can generate a push on the tubular loading device 6 capable of positioning it as shown in FIG. 4. Alternatively, it is possible to provide an electrical drive that, without the preventive pressure on the tubular loading device, generates the position shown in FIG. 4. Once the position of FIG. 4 is reached, the loading device 6 can be easily grasped by the user and extracted further to perform the loading operations. FIG. 5 shows for completeness a further extraction phase performed manually starting from the position of FIG. 4. Naturally, the repositioning of the tubular loading device 6 after loading takes place exactly in steps similar and opposite to those performed for its extraction, passing from FIG. 4 to FIG. 3. As known, the push-pull device is able to correctly lock the tubular loading device 6 in place and keep it permanently in the position in FIG. 3.

Figure 6:
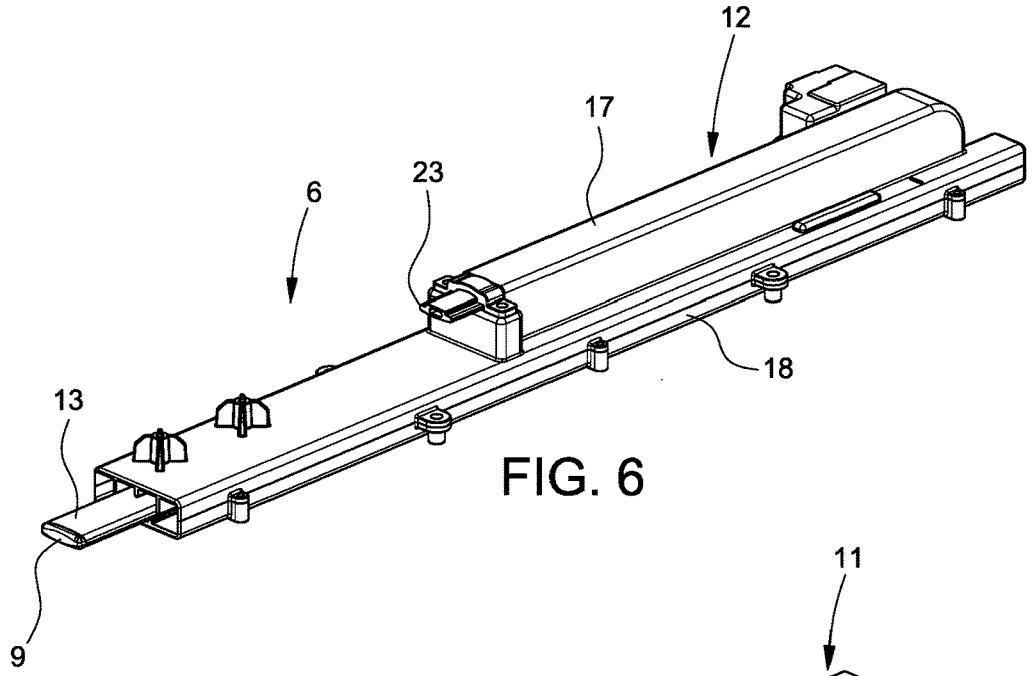
FIGS. 6-8 show views of a first embodiment of the tubular system for loading water in the oven according to the present invention.
Figure 7:
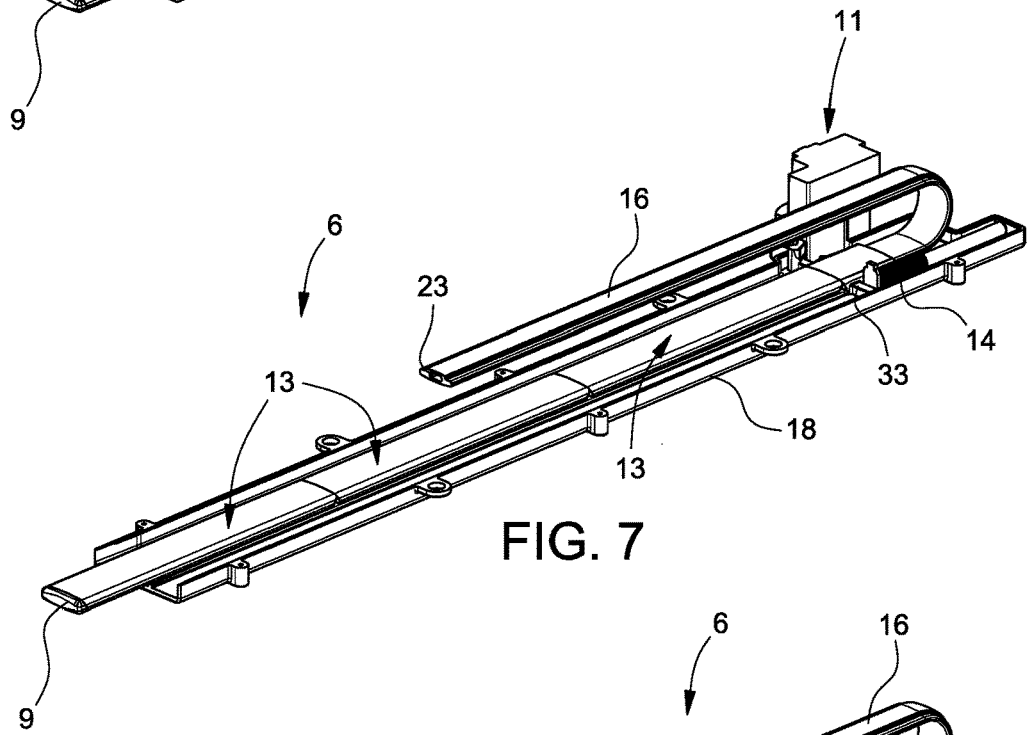
Figure 8:
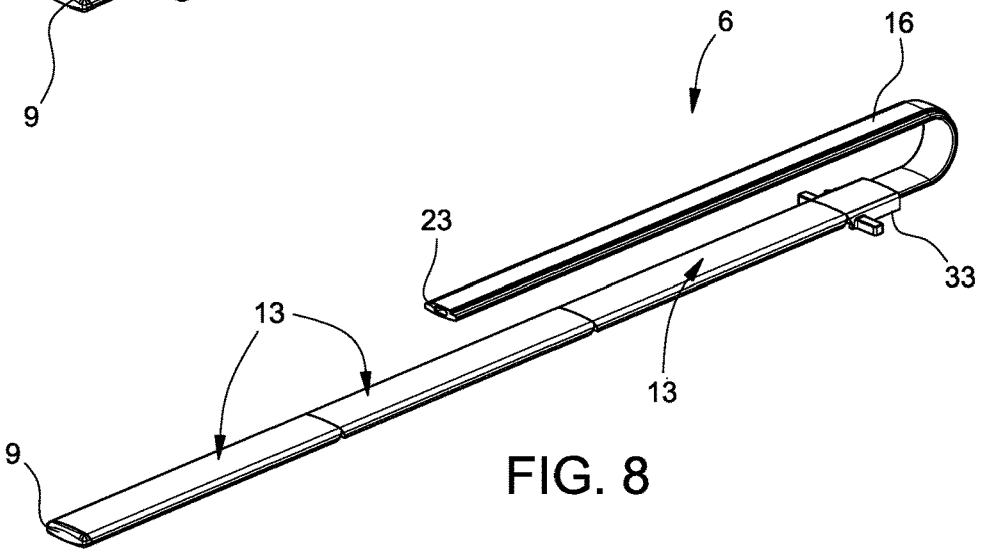

FIGS. 6-8 show in detail a first preferred embodiment of a tubular loading device 6 and its fixed seat according to the present invention.

Figure 11:
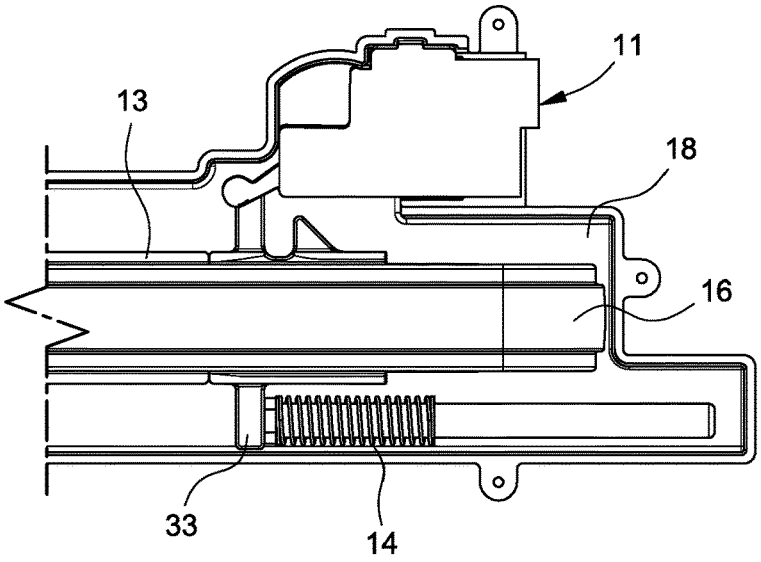

FIG. 6 shows the tubular device 6 housed in a seat 12. This seat 12 is fixed in the gap 10 between the muffle 2 and the outer frame 7 in a position such that from its front opening the end 9 exits and is as shown in FIG. 3 with respect to the front face of the oven. In the embodiment shown the seat 12 is made by joining two upper 17 and lower 18 half-shells connected to each other. The seat 12 is thus shaped like a case and is open at the front to allow the extraction of the tubular loading device 6 which in the not-working position is substantially housed for the most part in the seat 12. The seat 12 has a second opening from which the inner end of the tubular loading device 6 exits, i.e. the end connected directly or indirectly to the inner tank. This inner end 23 is connected to the seat and reaches this position after a return section of the tubular loading device 6 inside the seat 12. The housing of the tubular loading device 6 in the seat will be clarified with reference to FIG. 7. This FIG. 7 shows in fact the seat 12 without the upper half shell 17 and makes it possible to see how the tubular loading device 6 is arranged inside the seat 12. As seen, between the free end 9 and the fixed inner end 23 the tubular device has a return portion that is gradually unwound during extraction and rewound during insertion. Special guides can be provided inside the seat 12 to facilitate such operations. FIG. 7 shows how the push-pull mechanism 11 with its spring 14 is also housed inside the seat 12. More details of this push-pull mechanism can be seen in FIG. 11. In FIG. 8, the lower half shell 18 has been removed, leaving the position of the loading device 6 unchanged however. This FIG. 8 shows the elements composing the loading device 6 according to this embodiment. In particular, the loading device 6 comprises a tubular element 16 made of flexible material extending from the inner end 23 substantially to the free outer end 9 (which will be described in detail with reference to FIG. 9). The portion of the tubular member 16 at the free end 9 is coated with a coating 13 made of rigid material, for example aluminium. Such rigid material gives the end 9 greater solidity and therefore easier maneuverability for the user in the extraction and re-insertion phases 12 of the loading device 6. The coating 13 continues from the free end 9 substantially as far as an intermediate position of the tubular element 16 at which the tubular element 16 is provided with a rigid ring 33 that acts in conjunction with the push-pull mechanism 11. However, the coating 13 is not made in a single piece throughout its extension but in the form of a plurality of independent elements placed in succession. This embodiment also gives the coated portion the possibility of being at least partially flexible without losing the compression stiffness useful in the re-insertion operations of the loading device 6 into the seat 12. As will emerge below, the coating 13 is shaped to be coupled to the tubular element 16 by longitudinal sliding. Once the coating 13 is fitted, the end 9 is frontally closed by a suitable hard cap 34 on which the user acts to control the push-pull mechanism 11.

Figure 9:
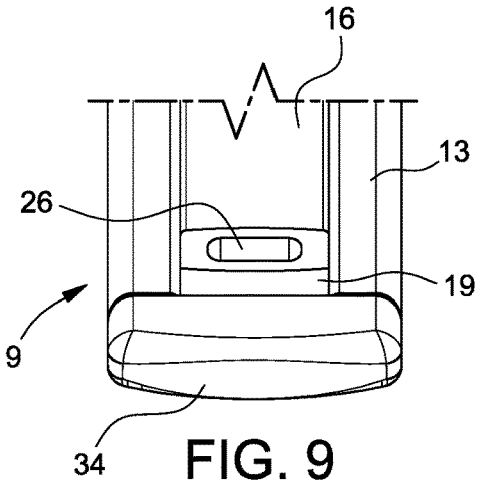
FIGS. 9-12 are enlarged views of details of the embodiment in FIGS. 6-8.

FIG. 9 shows the end 9 of the loading device 6 in detail and makes it possible to note that the coating 13 is fitted on the end of the tubular element 16 and the closing cap 34. As shown, between the cap 34 and the tubular element 16, a space 19, defining a lower opening, has been intentionally left to allow the water to be loaded to easily enter the tubular element 16 and thus reach the inner tank 5.

Figure 10:
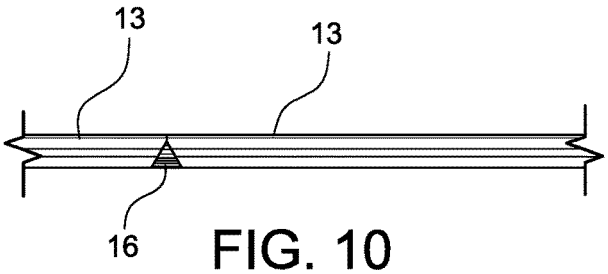

FIG. 10 shows in detail the contact area of two portions of the coating 13 fitted on the tubular element 16. As shown the adjacent ends of the coating 13 comprise both flared portions, so as to create a free flexural zone of the tubular element 16, and contact portions to make the compression structure rigid during the housing steps of the loading device 6 in the seat 12.

Figure 13:
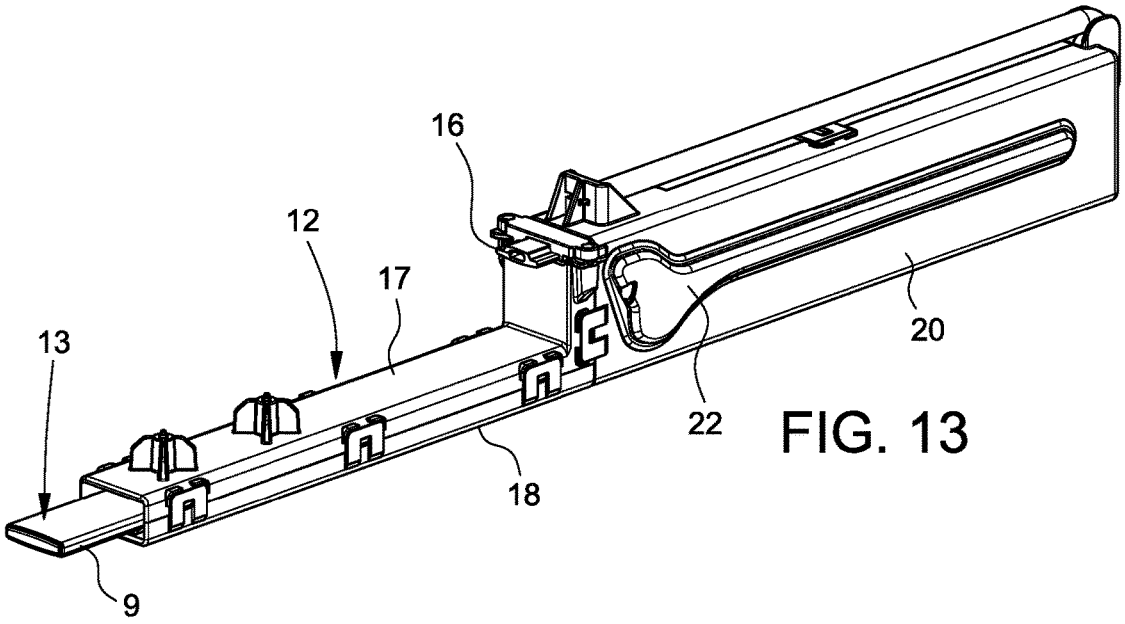
FIGS. 13-14 show views of a second embodiment of the tubular system for loading water in the oven according to the present invention.

FIG. 13 shows the cross-section of the tubular element 16 and the coating 13. In particular, FIG. 13 shows how the tubular element 16 has a flattened section, defined by the through opening of the through gap in the front wall of the oven, and an internal through water duct 26 that does not affect the entire transverse extension of the section but only a central portion. In this sense, laterally to the inner duct 26 the tubular portion comprises solid portions 27. Advantageously, both the coating 13 and the locking flange 35 of the inner end 23 weigh only on such solid portions 27 avoiding flattening of the duct 26.

Figure 14:
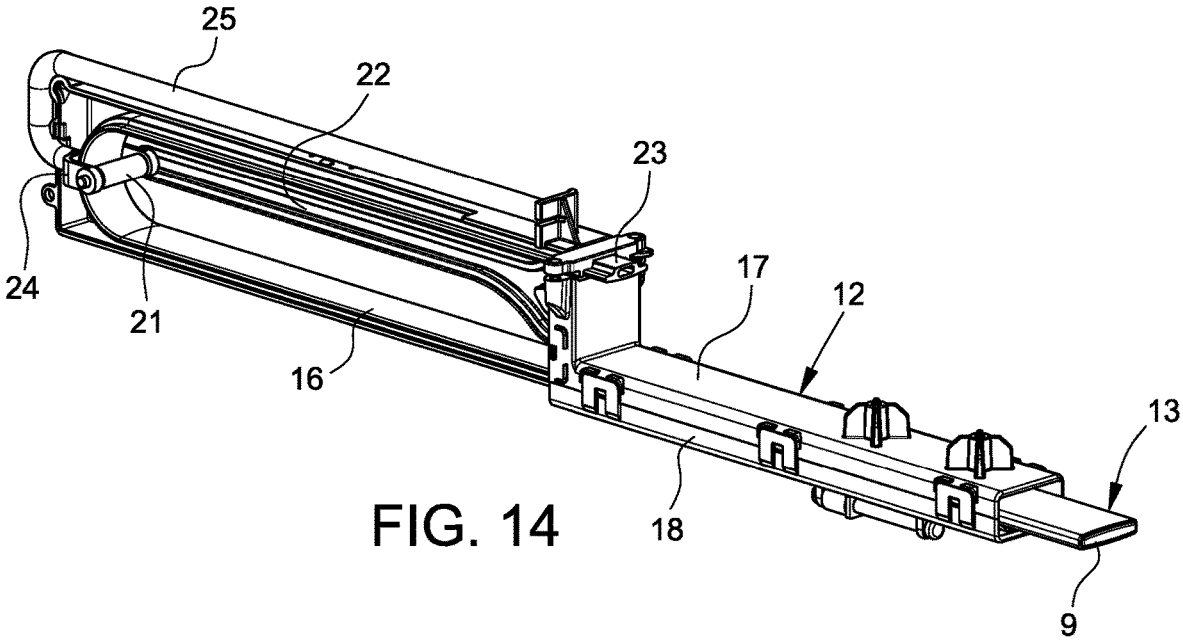

FIGS. 13 and 14 show an alternative embodiment of the extraction mechanism of the tubular device 6. In this embodiment the seat 12 formed by the half shells 17, 18 does not house the entire loading device 6 but only the portion of the flexible element 16 coated by the coating 13. A housing container 20 of the uncoated portion of the tubular element 16 is provided behind the seat 12. FIG. 14 then shows how the uncoated flexible portion 16 is returned inside the container 20 by a roller 21 sliding in guides 22 made inside the container 20. During extraction, the roller 21 advances from the rearward position towards the seat 12, allowing the flexible portion 16 to unwind. As seen, the roller 21 is further supported at the ends by a C-shaped fork 24 connected at the rear to elastic return means schematically shown by reference numeral 25. Such elastic means act on the fork 24 which in turn returns the roller 21 to the rearward position and thus the flexible portion 16. Advantageously, the guides 22 are made to create a stable retention seat of the roller 21 when the loading device 6 is extracted so that the user can proceed with loading the water without feeling the continuous elastic return. To release the roller 21 it is sufficient to impress a slight additional extraction force, once the roller is released, the elastic return will assist the winding of the flexible portion 16 in the container 20.

Figure 12:
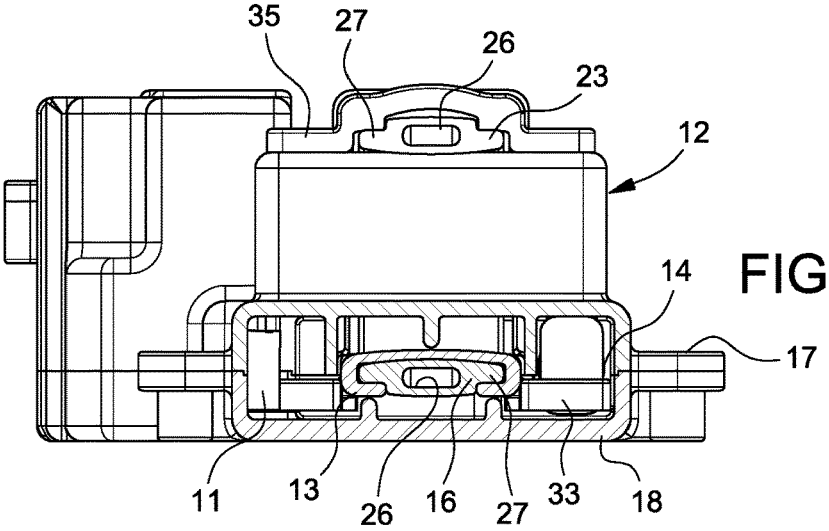
Figure 15:
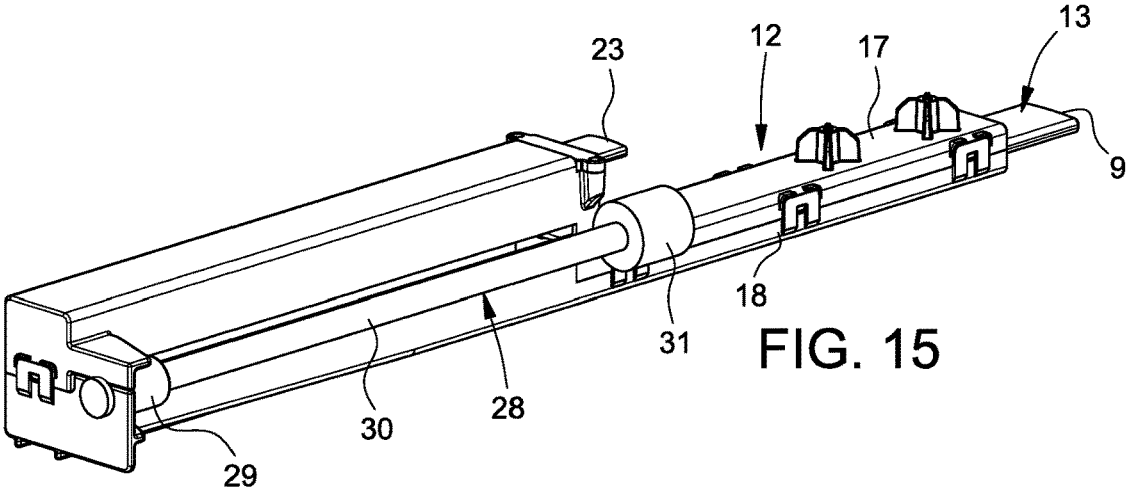
FIGS. 15-17 show views of a third embodiment of the tubular system for loading water in the oven according to the present invention.
Figure 16:
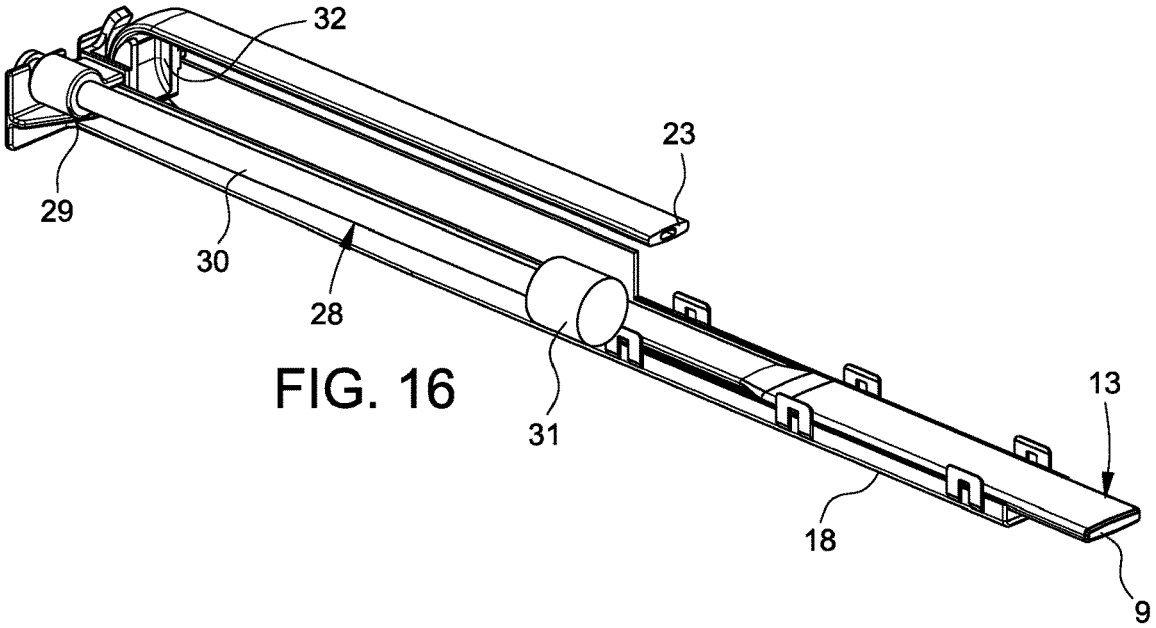
Figure 17:
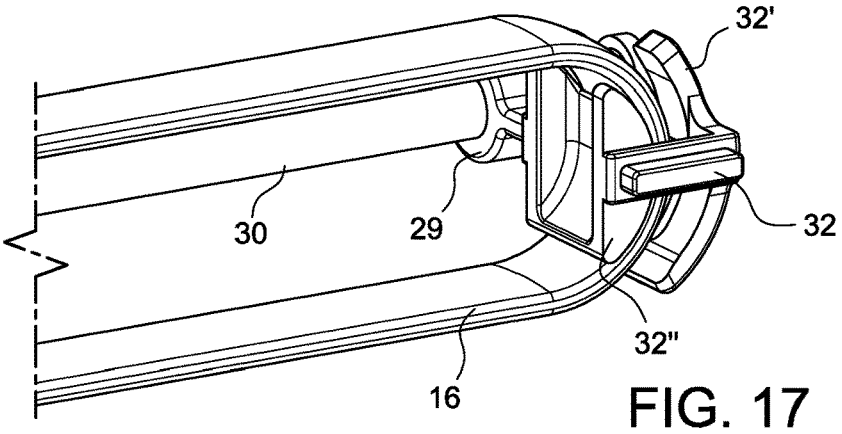

Lastly, FIGS. 15-17 show a third embodiment of the invention which provides for the automation of the complete extraction of the tubular loading device. In this embodiment, an actuator is provided, for example of an electric type and schematically shown by reference numeral 28, which includes a slider 29 movable along a guide 30 until it reaches an end stop 31. In the not-working position, the slider 29 is distal to the end 9 of the tubular device. The guide 28 runs externally to the seat 12 parallel to the extraction direction of the tubular device. FIG. 16 shows a slide 32 housed inside the seat 12 that collaborates with the uncoated flexible portion 16 to guide and operate the extraction and repositioning motion in the seat. Such slide is in fact connected or made directly in one piece with the slider 29 so that the advancement of the slider 29 along the guide 30 controls the advancement of the slide 32 which in turn pushes the tubular device 6 in extraction. FIG. 17 shows the slide 32 in detail. In particular, the slide 32 comprises two mutually facing portions that define a return C-seat for the uncoated flexible portion 16. In extraction, the flexible portion is pushed by the outer portion 32' of the slide while during repositioning, it is the inner portion 32" which acts against the flexible portion 16. As described above, such inner and outer portions of the slide act on the flexible portion not at the inner channel 26 but along the solid lateral portions 27 visible in FIG. 12.

Finally, it is specified that although the tubular device 6 was previously defined as "loading" water it can also be used to drain water from the tank. Without any structural change, it is in fact sufficient to provide special devices able to move the water in the opposite direction from the tank to the free end of the tubular device 6.

It is evident that modifications and variations can be made to the oven described herein while remaining within the scope of the appended claims.

The invention claimed is:

1. A heating apparatus comprising:

a cooking chamber limited by a plurality of fixed walls and by a door selectively mobile between an open position and a closed position for allowing respectively the accessibility and the isolation of the cooking chamber;

an internal tank for collecting water; and a tubular loading device for loading water into the internal tank, the tubular loading device comprising a flexible tubular element defining a transit channel for the water and comprising a free end, a fixed end coupled to the internal tank, and a return portion located between the free end and the fixed end, wherein the return portion of the flexible tubular element is configured to be unwound during extraction of the flexible tubular element and rewound during insertion of the flexible tubular element;

wherein both with the door in the open position and with the door in the closed position the tubular loading device is selectively mobile between a static not-working position and a loading position;

wherein the heating apparatus comprises an outer frame covering the cooking chamber; the tubular loading device being substantially fully housed inside a gap between the cooking chamber and the outer frame;

wherein the outer frame comprises a front portion coupling with the door to realize the front face of the heating apparatus, the tubular loading device passing the front face of the heating apparatus to switch from the not-working position to the loading position and vice-versa;

wherein between the door and the front portion of the outer frame a slot is present for the passage of the tubular loading device; and wherein the heating apparatus comprises a push-pull device configured at one side to constrain the tubular loading device in the not-working position and on the other side to release the tubular loading device from the not-working position and arrange the free end of the tubular loading device in a position projecting from the front face of the heating apparatus by a distance such as to be manually grasped.

2. The heating apparatus as claimed in claim 1, wherein the free end of the tubular loading device is directly accessible from the front face of the heating apparatus.

3. The heating apparatus as claimed in claim 2, wherein the free end of the tubular loading device is substantially flush with the front face of the heating apparatus.

4. A heating apparatus comprising:

a cooking chamber limited by a plurality of fixed walls and by a door selectively mobile between an open position and a closed position for allowing respectively the accessibility and the isolation of the cooking chamber;

an internal tank for collecting water;

a tubular loading device for loading water into the internal tank, the tubular loading device comprising a flexible tubular element defining a transit channel for the water and comprising a free end, a fixed end coupled to the internal tank, and a return portion located between the free end and the fixed end;

at least one roller; and a seat;

wherein the return portion of the flexible tubular element is configured to be unwound during extraction of the flexible tubular element and rewound during insertion of the flexible tubular element;

wherein both with the door in the open position and with the door in the closed position the tubular loading device is selectively mobile between a static not-working position and a loading position;

wherein the heating apparatus comprises an outer frame covering the cooking chamber; the tubular loading device being substantially fully housed inside a gap between the cooking chamber and the outer frame; and wherein during extraction of the flexible tubular element the at least one roller advances from a rearward position towards the seat, thereby allowing the return portion of the flexible tubular element to be unwound.

5. The oven as claimed in claim 4, wherein a portion of the flexible tubular element of the tubular loading device bends around a portion of the at least one roller.

6. The heating apparatus as claimed in claim 1, further comprising:

at least one roller, and a seat;

wherein during extraction of the flexible tubular element the at least one roller advances from a rearward position towards the seat, thereby allowing the return portion of the flexible tubular element to be unwound.

7. The heating apparatus as claimed in claim 6, wherein a portion of the flexible tubular element of the tubular loading device bends around a portion of the at least one roller.

8. An oven comprising:

a cooking chamber comprising a plurality of walls and a door selectively mobile between an open position and a closed position;

an internal tank for collecting water;

a tubular loading device for loading water into the internal tank, the tubular loading device comprising a flexible tubular element defining a transit channel for the water and comprising a first end, a second end coupled to the internal tank, and a return portion located between the free end and the fixed end, wherein the return portion of the flexible tubular element is configured to be unwound during extraction of the flexible tubular element and rewound during insertion of the flexible tubular element; and at least one roller, wherein a portion of the flexible tubular element of the tubular loading device bends around a portion of the at least one roller;

wherein the oven comprises an outer frame covering the cooking chamber.

9. The oven as claimed in claim 8, wherein the outer frame comprises a front portion coupling with the door to realize a front face of the oven, the tubular loading device passing the front face of the oven to switch from a not-working position to a loading position and vice-versa.

10. The oven as claimed in claim 9, wherein a free end of the tubular loading device is directly accessible from the front face of the oven.

11. The heating apparatus as claimed in claim 10, wherein the free end of the tubular loading device is substantially flush with the front face of the heating apparatus.

12. The oven as claimed in claim 9, wherein between the door and the front portion of the outer frame a slot is present for the passage of the tubular loading device.

13. The oven as claimed in claim 8, wherein the tubular loading device comprises:

a cover made of rigid material covering the tubular element at least at the free end.

14. The oven as claimed in claim 8, wherein the internal water tank is connected to a boiler to generate steam and introduce it into the cooking chamber.

15. The heating apparatus as claimed in claim 1, wherein the tubular loading device comprises:

a cover made of rigid material covering the tubular element at least at the free end.

16. The heating apparatus as claimed in claim 1, wherein the internal water tank is connected to a boiler to generate steam and introduce it into the cooking chamber.

17. The heating apparatus as claimed in claim 4, wherein the tubular loading device comprises:

a cover made of rigid material covering the tubular element at least at the free end.

18. The heating apparatus as claimed in claim 4, wherein the internal water tank is connected to a boiler to generate steam and introduce it into the cooking chamber.

* * * * *